United States Patent [19]

Matthews et al.

[11] 4,057,880

[45] Nov. 15, 1977

[54] METHOD OF PRODUCING SNAG RESISTANT HOSIERY ARTICLE

[75] Inventors: Robert M. Matthews, Pittsboro; William J. Lawson, Siler City, both of N.C.

[73] Assignee: Kellwood Company, St. Louis, Mo.

[21] Appl. No.: 725,998

[22] Filed: Sept. 23, 1976

[51] Int. Cl.[2] ..... D04B 1/26; D02G 1/00

[52] U.S. Cl. ..... 28/154; 28/218; 66/178 A; 66/202

[58] Field of Search ..... 28/72 FT, 72.16, 218, 28/154; 66/178 A, 202

[56] References Cited

U.S. PATENT DOCUMENTS

| | | | |
|---|---|---|---|
| 2,601,451 | 6/1952 | Page | 28/72.16 UX |
| 3,330,018 | 7/1967 | Silver et al. | 28/72.16 |
| 3,365,873 | 1/1968 | Matsumato et al. | 28/72 FT X |
| 3,413,796 | 12/1968 | Comer et al. | 66/202 UX |

FOREIGN PATENT DOCUMENTS

| | | | |
|---|---|---|---|
| 45-27067 | 9/1970 | Japan | 28/218 |
| 46-42064 | 12/1971 | Japan | 28/72 FT |
| 1,089,059 | 11/1967 | United Kingdom | 66/202 |

OTHER PUBLICATIONS

Richardson et al., Dyeing and Finishing of Ladies Full Length Seamless Hosiery Made of DuPont Cantrece Nylon, American Dyestuff Reporter, pp. 20–25, Aug. 17, 1964.

Producing Ladies Full Length Seamless Hosiery of DuPont Fiber H Nylon Hosiery Yarns, July 1963, pp. 1–13.

Textured Yarn Technology vol. 1, Ala., Monsanto Company, 1967, pp. 139, 140.

*Primary Examiner*—Robert R. Mackey

*Attorney, Agent, or Firm*—Bell, Seltzer, Park & Gibson

[57] ABSTRACT

The snag resistant leg portion of this hosiery article is knit of a composite self-crimping yarn including a series of mechanical crimps imparted thereto prior to knitting, and a series of crimps imparted to the composite yarn by development of the latent crimp in the composite yarn after knitting. The hosiery article knit of the composite self-comprising yarn having both types of crimp therein has much greater snag or pick resistance than either a hosiery article knit of the same type of composite yarn but including only the crimps imparted by development of the latent crimp in the yarn, or a hosiery article knit of yarn having mechanical crimp only. The knitting of a mechanically crimped composite yarn also produces a normal size greige hosiery article blank which may be processed in the usual manner to produce the finished hosiery article.

2 Claims, 9 Drawing Figures

METHOD OF PRODUCING SNAG RESISTANT HOSIERY ARTICLE

This invention relates generally to a snag or pick resistant hosiery article and method of producing the same and more particularly to such a hosiery article which is knit of a mechanically crimped composite self-crimping yarn so that the yarn in the finished hosiery article has two different types of crimp. The two different types of crimp imparts a high degree of snag resistance to the hosiery article and permits the knitting of a normal size greige hosiery article blank which may be processed in the usual manner.

Mechanically crimped yarns have heretofore been utilized in the knitting of ladies' sheer stretchable hosiery articles, such as stockings and panty hose. For example, such yarns have been mechanically crimped by knitting the yarn, setting the stitch loop configuration in the yarn, unraveling the yarn, the then knitting the hosiery article of such "knit-de-knit" yarn. Examples of such hosiery articles are disclosed in the U.S. Pat. to Page No. 2,601,451 and Mattingly U.S. Pat. No. 3,522,717. It is also known to mechanically crimp hosiery yarns by engaging the yarn with crimping elements to maintain the yarn in a sinuous path while this sinuous configuration is set in the yarn. Examples of this type of mechanical crimping of yarns are disclosed in U.S. Pat. to Swartz No. 2,696,034; Lawson et al U.S. Pat. No. 2,812,569; and Rice U.S. Pat. No. 3,256,134. Hosiery yarns have also been mechanically crimped by passing the yarns through gears and setting a gear type sinuous configuration in the yarn. Examples of this type of mechanical crimping are disclosed in the U.S. Pat. to Laros No. 2,668,430.

However, all of these mechanical crimping methods induce a single type of crimp in the yarn which primarily distorts the yarn in a single plane. Hosiery articles knit of this type of mechanically crimped yarn have sufficient stretchability to fit several leg sizes but these hosiery articles have a very low degree of snag or pick resistance.

It is also known to produce stretchable hosiery articles by knitting the hosiery article of a composite self-crimping yarn which is produced by the conjugate spinning of two or more components in either a side-by-side or a sheath-core relationship. Examples of such composite self-crimping hosiery yarns are disclosed in U.S. Pat. to Hollandsworth No. 3,244,785, Olson U.S. Pat. Nos. 3,399,108; 3,558,760; and 3,779,853, Ogata et al U.S. Pat. No. 3,788,940 and Aishima et al U.S. Pat. No. 3,900,678. These composite self-crimping yarns must be knit in the form of large, open stitch greige blanks which are subjected to a heat treating process immediately after knitting to develop the latent crimp in the yarn. This type of crimp is of a more three dimensional nature than the mechanical type crimp because this yarn, if unrestrained during the heating process, forms a very strong spiral or spring-like crimp or configuration along the length thereof.

However, hosiery articles knit of this type of composite self-crimping yarn must be knit in a large loose manner so that the crimp may be sufficiently developed. The hosiery blanks must be knit of such a large size that it is often necessary to modify the hosiery knitting machine to accommodate the large greige hosiery blanks. Also, it is necessary to develop the crimp in the greige blank immediately after knitting and before carrying out the other normal procedures in producing the hosiery article, such as toe closing, slitting, seaming and inspecting. This development of the crimp immediately after knitting requires an extra step and a change in the normal hosiery article producing procedure.

With the foregoing in mind, it is an object of the present invention to provide a snag or pick resistant hosiery article which is knit of a composite self-crimping yarn including a series of mechanical crimps imparted to the yarn prior to knitting and series of crimps imparted to the composite yarn by development of the latent crimp in the composite yarn after knitting. The presence of the mechanical crimp imparted to the yarn prior to knitting permits the production of a normal size greige hosiery article blank which may be processed in the usual manner and the hosiery article formed of the composite yarn with both types of crimp therein has a greatly enhanced degree of snag or pick resistance In accordance with the present invention, mechanical type crimps are imparted to a composite self-crimping yarn prior to knitting by arranging the yarn in a sinuous configuration and heat setting the yarn in the sinuous configurations; this yarn is then knit to form a normal size greige hosiery article blank; the greige blank is finished; and the completed hosiery article is then subjected to a heat treatment to develop the latent crimp in the composite yarn. Various type of composite self-crimping yarns, usually referred to as bicomponent or biconstituent yarns, may be utilized in producing the snag or pick resistant hosiery articles of the present invention. These composite self-crimping yarns may include various combinations of two or more synthetic components, such as nylon, polyester, polypropylene or spandex.

The snag or pick resistance of the hosiery of the present invention is increased because of the presence of the two different types of crimp in the stitch loops of the finished hosiery article which it is believed act to prevent the "robbing" of yarn from adjacent stitch loops when a yarn is pulled in a particular stitch loop. The two different types of crimp in the yarn actually cause the formation of randomly spaced complete 360° coils in the individual filaments and these coils are believed to provide additional resistance to the withdrawal of yarn from adjacent stitch loops to thereby increase the snag or pick resistance of the finished hosiery article.

Yarns of the type employed in knitting ladies' sheer hosiery articles, such as panty hose, are usually within the range of about 15 to 50 denier and are usually composed of plural continuous filaments and the present invention is particularly concerned with snag resistant hosiery articles knit of this type yarn. Snag resistant hosiery articles in accordance with the present invention have been formed of a composite self-crimping yarn which has been mechanically crimped prior to knitting by the well-known knit-de-knit process. However, mechanical crimps may be imparted to the composite self-crimping yarn by other known processes which involve arranging the yarn in a sinuous configuration and heat setting the yarn in this sinuous configuration.

Other objects and advantages will appear as the description proceeds when taken in connection with the accompanying drawings, in which FIG. 1 is a perspective view of a prior art type of greige hosiery article blank knit to the large dimensions recommended by the producers of the composite self-crimping yarn;

Figure 2:
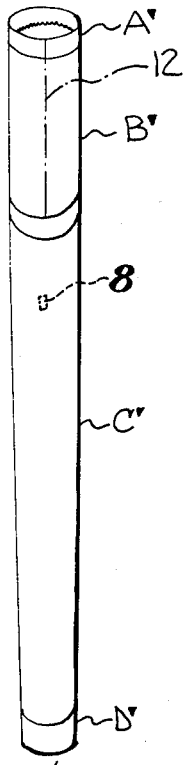
FIG. 2 is a view similar to FIG. 1 but showing the comparatively smaller dimension of the greige hosiery article blank knit of the mechanically crimped composite self-crimping yarn in accordance with the present invention.
Figure 3:
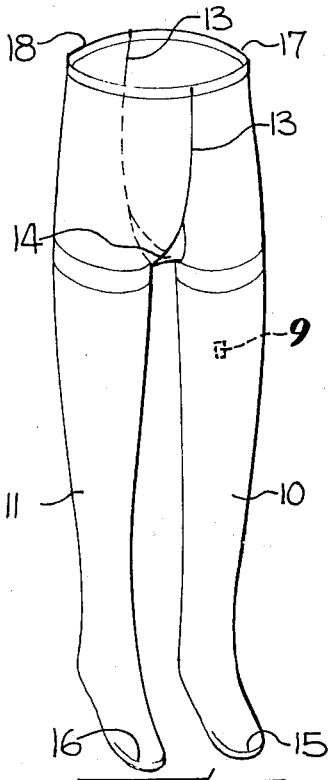
FIG. 3 is a front perspective view of a finished panty hose garment formed by slitting and sewing together two greige hosiery article blanks of the type shown in FIG. 2.
Figure 4:
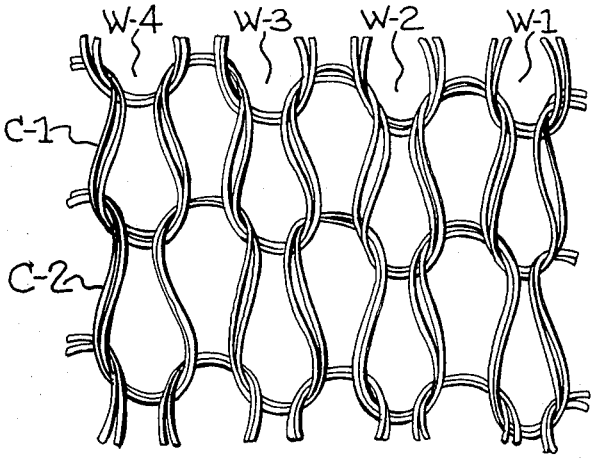
Fig-4 (PRIOR ART)
FIG. 4 is a greatly enlarged fragmentary view of a portion of the upper thigh of the prior art type of greige hosiery article blank shown in FIG. 1, being taken substantially in the dotted area 4, and illustrating the uncrimped configuration of the yarns in the stitch loops.
Figure 6:
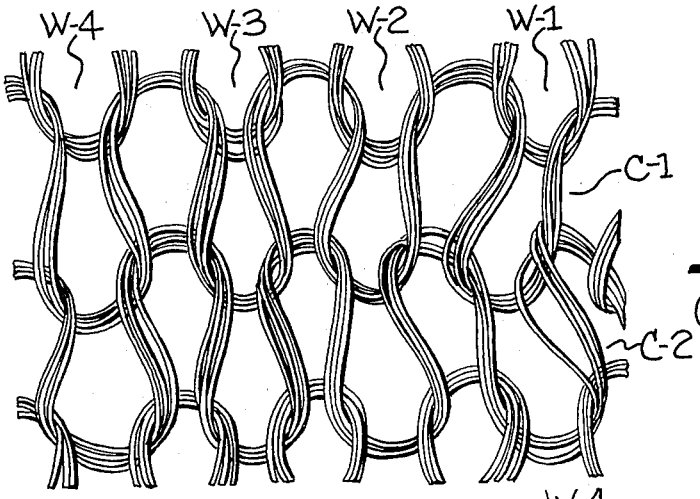
FIG-6 (PRIOR ART)
FIG. 6 is a greatly enlarged fragmentary view of a portion of the upper thigh of a greige hosiery article blank knit of 18/3 raw nylon yarn which has been subjected to a mechanical crimping by the knit-de-knit process and illustrating the substantially uncrimped configuration of the yarn in the stitch loops.
Figure 8:
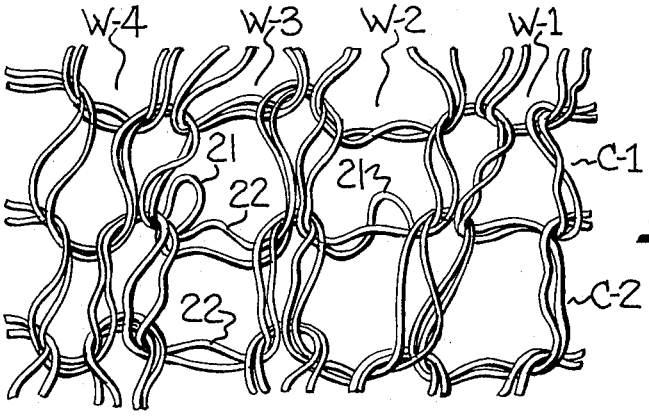
Figure 9:
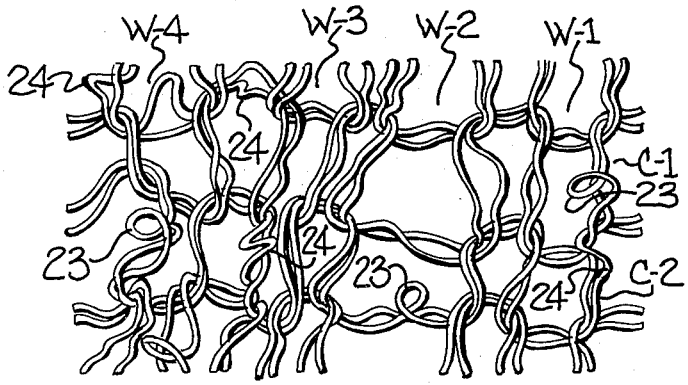

FIG. 8 is a view similar to FIG. 4 but illustrating the crimped nature of the yarn in the thigh area of the greige hosiery article blank illustrated in FIG. 2 and being taken substantially in the dotted area 8; and FIG. 9 is a view similar to FIG. 6 but illustrating the two different types of crimp imparted to the yarn in the stitch loops after subjecting the finished panty hose garment to a heat treatment process to develop the latent crimp in the mechanically crimped composite self-crimping yarn, being taken substantially in the upper thigh area of one leg and in the dotted area 9 in FIG. 3.

As pointed out above, various types of composite self-crimping yarns have been produced for use in knitting stretchable hosiery articles. Among the more popular of these composite self-crimping yarns presently available are "Cantrece" manufactured by DuPont and "Monvelle" manufactured by Monsanto Textile Company. More recently, a new composite self-crimping yarn has been introduced by DuPont and this yarn is known as N-780. To produce hosiery articles such as panty hose, from this new type of composite self-crimping yarn, DuPont recommends that the individual hosiery blanks be knit very large and with a loose or open stitch construction. It is also recommended that the hosiery blank be subjected to a heat treatment process immediately following the knitting operation to develop the latent crimp in the yarn and to reduce the number of picks which occur handling in the subsequent processing steps. Even with this immediate development of the crimp, a large number of picks and snags still occur in the hosiery blanks.

Figure 1:
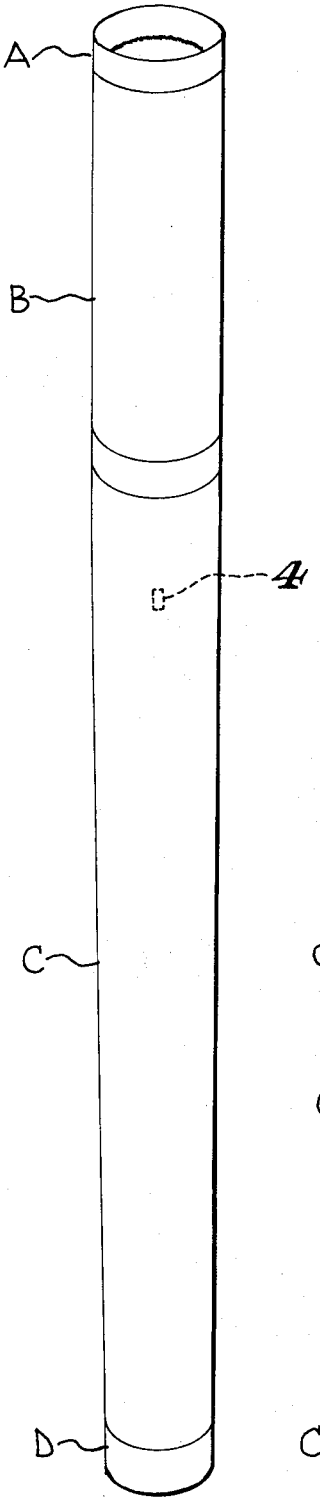
Fig-1 (PRIOR ART)

The recommended knitting lengths of the various parts of a griege panty hose blank, of the type shown in FIG. 1, are listed under "Conventional Blank" in Table I below with the waistband portion being indicated in FIG. 1 at A, the panty portion being indicated at B, the leg and foot being indicated at C, and the toe and ravel guard being indicated at D in FIG. 1.

TABLE I

| | Conventional Blank | Invention Blank |
|---|---|---|
| Waistband - Sections A & A' | 1½ | 1 |
| Panty - Sections B & B' | 21 | 8½ |
| Leg and Foot - Sections C & C' | 50½ | 26½ |
| Toe and Ravel guard - Sections D & D' | 2 | 1½ |
| Total Length | 75" | 37½" |

As shown in Table I, the overall length of the hosiery article blank is 75 inches and the diameter of the tubular panty hose blank is also larger than a normal panty hose blank. For example, the medial portion of the panty portion B in flattened condition measures 7 inches across while the lower portion of the leg and foot portion C measures 6 ¼ inches. The straight, uncrimped condition of the two-filament yarn in the leg and foot portion of the greige blank (FIG. 4) offers no resistance to robbing of yarn from adjacent stitch loops when a yarn is pulled in a particular stitch, thereby permitting snags or picks to be easily formed in the greige stocking blank, prior to development of the latent crimp in the yarn. Because of the large size and open structure of the greige blank, the yarn producer recommends that the crimp be developed immediately following knitting to reduce handling difficulties and the formation of snags and picks in the fabric in later stages of production. The recommended method of developing the crimp involves the tumbling of the hosiery blanks in atmospheric steam (212° F) for 20 minutes with the temperature being raised to 212° in less than three minutes and with the tumbling being continued until the goods are cooled to 160° F. Alternatively, the crimp can be developed by scouring the blank at the boil in a dye tub for 20 to 30 minutes, rinsing in cold water for ten minutes, and the tumbling dry at 180° F for 20 minutes.

On the other hand, when the hosiery blank is knit of a mechanically crimped composite self-crimping yarn in accordance with the present invention, the need for a crimp development process immediately after knitting is eliminated and the greige hosiery blank produced on the knitting machine is of a normal size which can be processed in the usual manner. Table I above provides a graphic comparison between the knitted lengths of the various parts of the hosiery blank, knit in the manner recommended by the producer of the composite self-crimping yarn (FIG. 1) and, referred to as a "Conventional Blank," and the knitted lengths of the corresponding parts of the greige hosiery blank knit of the mechanically crimped composite self-crimping yarn in accordance with the present invention (FIG. 2), referred to as the "Invention Blank."

Thus, the individual portions A–D of the greige blank shown in FIG. 1 are each longer than the corresponding portions A'–D' of the greige blank of the present invention. As will be noted, the overall length of the conventional blank is twice as long as the overall length of the blank produced in accordance with the present invention (FIG. 2). Also, the width or diameter of the blank of the present invention is also reduced. As described above, the flattened width of the panty portion of the conventional blank (FIG. 1) is 7 inches while the lower portion of the leg section at about the ankle is 6¼ inches. However, the width of panty portion of the invention blank (FIG. 2) is 3⅝ inches while the lower ankle portion of the invention blank is 2¾ inches.

Also, the producer of the composite self-crimping yarn recommends that a particular number of courses be knit in each of the portions A–D of the greige blank (FIG. 1). The recommended number of courses to be knit in the various portions of an average size greige blank is set forth under the column "Conventional Blank" in Table II below.

TABLE II

| | Conventional Blank | Invention Blank |
|---|---|---|
| Waistband - Sections A & A' | 192 | 144 |
| Panty - Sections B & B' | 936 | 552 |
| Leg and Foot - Sections C & C' | 2,544 | 2,160 |
| Toe & Ravel guard - Sections D & D' | 216 | 216 |
| TOTAL COURSES | 3,888 | 3,072 |

It has been found that a greige blank knit of a mechanically crimped composite self-crimping yarn in accordance with the present invention can be knit with a substantially lesser number of courses, thereby saving on knitting time. For example, the number of courses required in knitting each of the portions A'–D' are listed in the above Table II. As will be noted, the greige blank of the present invention (FIG. 2) requires 816 less courses than the number of courses in the conventional blank (FIG. 1) so that approximately a 25 percent savings in time is realized by knitting the hosiery blank of mechanically crimped self-crimping yarn in accordance with the present invention.

The normal size greige blank produced in accordance with the present invention is then utilized, with another greige blank, to form a panty hose garment, of the type illustrated in FIG. 3. The panty hose includes a first hosiery blank 10 forming one leg and one-half of the panty portion and a second blank 11 forming the other leg and the other half of the panty portion. The upper ends of the two blanks are slit vertically, in the manner indicated by the dash dot line 12 in FIG. 2, and the corresponding edges of these slits are sewn together along a single U-shaped seam line 13 which extends from the rear to the front of the waist opening and downwardly through the crotch. If desired, a diamond shape or other desired shape of crotch panel 14 can be sewn into the crotch of the garment. The toes of the garment are closed, as by seams 15, 16, which may be formed before or after the two blanks are sewn together. The panty hose shown in FIG. 3 is illustrated as being provided with a waistband formed by turned welts 17, 18 on the upper ends of the respective blanks 10, 11. If desired, an elastic waistband may be provided at the upper end of the panty hose. Of course, it is understood that other types of panty hose and other types of knitted articles or garments can be produced in accordance with the present invention.

The reason for the increase in snag or run resistance of the hosiery article of the present invention is best demonstrated by referring to FIGS. 4–9 which compares the appearance of the yarns in the greige and finished conventional prior art type garments (FIGS. 4, 5 and 6, 7) with the greige and finished garments in accordance with the present invention (FIGS. 8 and 9). These drawings are tracings of microphotographs taken in the upper leg areas of the three types of garments.

The greige fabric (FIG. 4) and the finished fabric (FIG. 5) are knit of DuPont type N-780 composite self-crimping 20/2 denier yarn and the greige hosiery blank is finished in the manner recommended by the yarn manufacturer. As will be noted in FIG. 4, the two-filament yarn follows even and uniformly curving paths of travel in the stitch loops in wales W-1 through W-4 of courses C-1 and C-2. This greige blank fabric is very easy to pick and snag since the individual filaments are separated in each of the stitch loops and should one or both of the filaments in a stitch loop be pulled from the fabric, there is very little resistance to prevent the pulling or robbing of the yarn from adjacent stitch loops in the same course so that the stitch loops of adjacent courses are pulled together.

Figure 5:
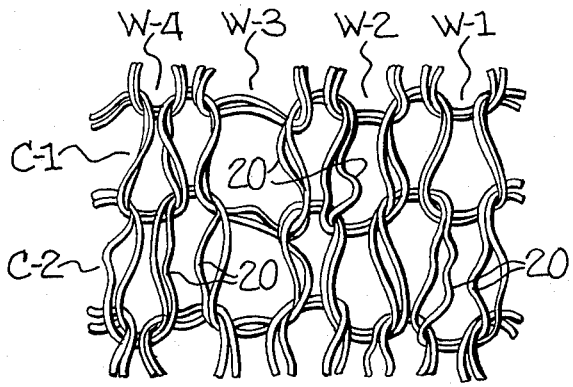
Fig-5 (PRIOR ART)
FIG. 5 is a view similar to FIG. 4 but illustrating the appearance of the yarn after the large greige hosiery blank of FIG. 1 has been subjected to a heat treatment process to develop the latent crimp therein.

After this conventional type of hosiery blank is finished to develop the latent crimp in the yarn, the stitch loops in the needle wales become somewhat distorted. As shown in FIG. 5, the stitch loops in wale W-4 are narrow while the stitch loops in wale W-3 are very wide. This distortion of stitch loops is believed to be caused by the composite self-crimping yarn attempting to assume the spiraled configuration which it would assume, if it were not restrained by the crossovers of the stitch loops. The development of the latent crimp also causes the formation of kinks or curls in the filaments, the more pronounced of which being indicated at 20 in FIG. 5. While these kinks or curls 20 offer some resistance against the pulling of the yarn and thereby reduce the tendency to snag and pick up a small amount, this type of hosiery article still has a low degree of pick and snag resistance.

The greige hosiery blank (FIG. 6) and the finished hosiery article (FIG. 7) are knit of 18/3 denier raw nylon yarn which has been subjected to a mechanical crimping by the knit-de-knit process, prior to being knit to form the hosiery article. As will be noted in FIG. 6, the three filament yarn follows substantially even and uniformly curving paths of travel in the stitch loops in wales W-1 through W-4 of courses C-1 and C-2. This greige hosiery blank is very easy to pick and snag since the individual filaments are slightly separated in the stitch loops and should one or more of the filaments in a stitch loop be pulled from the fabric, there is very little resistance to prevent the pulling or robbing of the yarn from adjacent stitch loops in the same course so that the stitch loops of adjacent courses are pulled together.

After this conventional type of hosiery blank is finished, the stitch loops are still not distorted to any great extent, although the individual filaments of the yarn do appear to be more widely separated than in the unfinished fabric (FIG. 6). While hosiery articles knit of this conventional prior art type of knit-de-knit yarn do have sufficient stretchability that they will fit a range of foot and leg sizes, the pick and snag resistance of such hosiery articles is even lower than the pick and snag resistance of the conventional type of hosiery blank knit of the composite self-crimping yarn (FIGS. 4 and 5). Thus, in the knit-de-knit type of hosiery article (FIGS. 6 and 7), there is no pronounced crimp or curl in the filaments so that there is very little or no resistance against the pulling of the yarn so that this fabric will snag and pick very easily.

In the greige hosiery blank in accordance with the present invention (FIG. 8), the individual filaments of the mechanically crimped composite self-crimping yarn are much more widely separated and follow different paths with definite crimps being formed therein. It is believed that the substantially U-shaped crimps, indicated at 21, are those which were set in the yarn by the knit-de-knit mechanical crimping process. Also, the greige blank (FIG. 8) contains kinks or curls, indicated at 22, which are believed to be formed by the partial development of the latent crimp in the composite self-crimping yarn during the heat treatment step of the knit-de-knit process. Thus, the crimps in the yarn cause the stitch loops to contract as soon as they are released from the needles so that a hosiery article blank of normal size may be knit. The crimps in the greige blank make it much more difficult to snag and pick this greige blank because the yarns do not easily pull through the stitch crossovers.

When the hosiery article blank of the present invention is finished (FIG. 9), the individual filaments of the mechanically crimped composite self-crimping yarn are even further crimped, curled and distorted. In fact, complete 360° coils are formed in certain positions along the filaments, as illustrated at 23 in FIG. 9. It is believed that these complete coils are formed at locations where the full development of the latent crimp coincides with the mechanical crimp. Also, substantially U-shaped crimps, indicated at 24 in FIG. 9, are formed in certain positions along the filaments. It is believed that these U-shaped crimps are formed at locations where a partial development of the latent crimp coincides with the mechanical crimp.

In any event, the filaments of the yarn in the finished hosiery article are so distorted that it is most difficult to pull the yarn from one stitch loop through the adjacent stitch loop crossovers and the snag resistance is greatly increased. It has been found that the presence of both the mechanical crimps imparted to the yarn prior to knitting and the development of the latent crimp in the composite yarn after knitting increases the snag resistance of this type of hosiery article by at least two times the snag resistance of a corresponding hosiery article knitted of the same type of composite yarn by including only a series of crimps imparted to the composite yarn by development of the latent crimp therein. Also, the pick and snag resistance of the present hosiery article has been found to be about one hundred and thirty-five greater than the pick and snag resistance of hosiery articles knit of conventional raw yarns which have been crimped by the knit-de-knit process.

The hosiery article of the present invention has been tested for pick and snag resistance and compared with the pick and snag resistance of conventional hosiery articles knit of composite self-crimping yarn as well as with conventional hosiery articles knit of yarns which include only mechanical crimp, imparted thereto by the knit-de-knit process. The various types of hosiery articles have been tested under identical conditions on a hosiery pick and snag tester which includes a rotatable cylinder on which the upper leg portions of the hosiery articles are supported in a stretched condition which corresponds to the condition the hosiery article assumes when worn. The cylinder is 6 inches long and has a circumference of 15¾ inches and a piece of 4 inch × 4 inch No. 280-A silicon carbide sandpaper is supported with one edge in resilient engagement with the hosiery article on the cylinder. The cylinder is rotated ten revolutions with the sandpaper in engagement with the hosiery article. After ten revolutions of the cylinder, the number of picks or snags formed in a delineated 16 square inch area on the cylinder are counted and recorded. Each hosiery article to be tested is placed on the cylinder and tested under identical conditions.

The results of the pick and snag tests conducted on the three different types of hosiery articles are recorded below in Table III. The total number of picks in the 16 square inch area of six hosiery articles of each type were counted and recorded. The average number of picks in the 16 square inch area and the average number of picks per square inch of each type of hosiery article were also calculated.

TABLE III

| Type of Texture Nylon | K.D.K. Raw N-780 | Conventional N-780 | K.D.K. |
|---|---|---|---|
| Leg Yarn | 18/3 | 20/2 | 20/2 |
| Snags - Test 1 | 113 | 2 | 2 |
| Snags - Test 2 | 126 | 2 | 0 |
| Snags - Test 3 | 135 | 4 | 0 |
| Snags - Test 4 | 128 | 1 | 2 |
| Snags - Test 5 | 142 | 3 | 2 |
| Snags - Test 6 | 136 | 3 | 0 |
| Total Snags | 780 | 15 | 6 |
| Average 16 Sq. " | 130 | 2.5 | 1 |
| Average per Sq. " | 8.1 | .15 | .06 |

Figure 7:
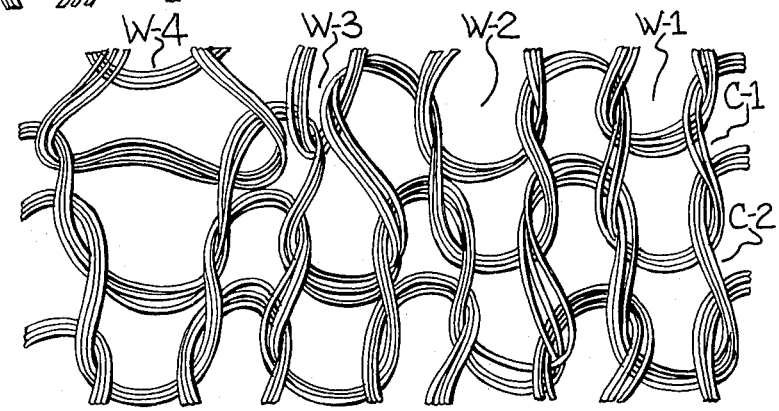
FIG-7 (PRIOR ART)
FIG. 7 is a view similar to FIG. 6 but illustrating the appearance of the yarn after the greige hosiery blank has been subjected to a heat treatment process in finishing the hosiery article.

The hosiery articles in the left-hand column of Table III, headed "K. D. K. Raw Nylon," were hosiery articles knit of mechanically crimped raw or regular nylon yarn only and the mechanical crimp was imparted to the yarn prior to knitting by the knit-de-knit process (FIG. 7). The hosiery articles under the column headed "Conventional N-780" were hosiery articles knit and finished in accordance with the recommendations of the composite self-crimping yarn producer (FIG. 5). The hosiery articles under the right-hand column, headed "K. D. K. N-780," were knit of a composite self-crimping yarn having a series of mechanical crimps imparted thereto prior to knitting by the knit-de-knit process (FIG. 9), in accordance with the present invention.

As indicated in the last two columns on the right, the finished hosiery article of the present invention averages 2½ times as pick or snag resistant as a conventional N-780 hosiery article. Thus, the present hosiery article is at least two times as snag or pick resistant as a conventional N-780 hosiery article. Comparing the hosiery article of the present invention, right-hand column, with the hosiery article in the left-hand column, it will be noted that the hosiery article of the present invention is one hundred and thirty-five times as snag or pick resistant as the hosiery articles of yarn having only mechanical crimp produced by the knit-de-knit process.

As one non-limiting example of the formation of panty hose in accordance with the present invention, the mechanically crimped composite self-crimping yarn used in the panty portion and the leg portion of the hosiery blank is preferably of different denier. It has been found that satisfactory panty hose garments can be knit by utilizing DuPont N-780 yarn of 20/2 denier in the leg portion and DuPont N-780 yarn of 38/6 denier in the panty portion. Before knitting, the raw N-780 yarn is knit on a 340 needle circular knitting machine, the tubular fabric is then subjected to a heat treatment to set the stitch loop configuration in the yarn, and then the fabric is unraveled and the knit-de-knit yarn is wound onto knitting cones. The cones are then placed on a conventional hosiery knitting machine having 403 needles and the greige panty hose blanks are knit of this yarn. The greige blanks produced with this mechanically crimped composite self-crimping yarn are of substantially the normal size, as illustrated in FIG. 2, and may be processed in the normal manner. As pointed out above, the knitting of the hosiery article with the knit-de-knit composite self-crimping yarn provides increased snag or pick resistance in the greige hosiery blanks so that they may be formed into the finished garments without snags or picks occurring in the finished hosiery article. Also, the finished hosiery article has enhanced snag or pick resistance and may be processed without any special procedure or extra steps being required in the finishing operation.

In the drawings and specifications there has been set forth a preferred embodiment of the invention, and although specific terms are employed, they are used in a generic and descriptive sense only and not for purposes of limitation, the scope of the invention being defined in the claims.

We claim:

1. A method of producing a stretchable hosiery article blank for use in forming panty hose characterized by increased snag resistance in at least certain portions thereof, said method comprising mechanically crimping a self-crimping bicomponent thermoplastic yarn, having the latent characteristic of becoming crimped when heated, by arranging the bicomponent yarn in a sinuous configuration including a series of stitch-like bends and heat setting the bicomponent yarn in said sinuous configuration, knitting the mechanically crimped bicomponent yarn while forming a normal size greige hosiery blank of substantially one-half the size of a corresponding greige hosiery blank knit of a self-crimping bicomponent yarn which has not been machanically crimped so that the normal size hosiery blank may be processed in the usual manner prior to development of the latent crimp, carrying out the normal procedures in producing a panty hose, such as toe closing, slitting, seaming and the like, forming additional crimp in the knitted mechanically crimped bicomponent yarn by developing the latent crimp characteristic thereof through the further application of heat to the panty hose whereby at least certain portions of the panty hose are formed of yarn having two distinct types of crimp, one type being imparted to the yarn prior to being knit in the hosiery blank and forming substantially U-shaped crimps in certain stitch loops, and the other type of crimp being imparted thereto after the yarn is knit in the hosiery blank and forming complete coils in certain stitch loops, said two types of crimp imparting substantially increased snag resistance to the portions of the panty hose formed of said bicomponent yarn.

2. A method according to claim 1 wherein said mechanical crimping step includes the steps of knitting the bicomponent yarn into a fabric to arrange the bicomponent yarn in the sinuous configuration by the formation of stitch loops thereof, setting the stitch loop configuration in the bicomponent yarn by heating the knit fabric, and unraveling the crimped and set yarn from the knit fabric.

* * * * *

UNITED STATES PATENT OFFICE

CERTIFICATE OF CORRECTION

Patent No. 4,057,880 Dated November 15, 1977

Inventor(s) Robert M. Matthews et al.

It is certified that error appears in the above-identified patent and that said Letters Patent are hereby corrected as shown below:

Under the cited U.S. Patent Documents, "Matsumato et al." should be -- Matsumoto et al. --.

In the Abstract, line 7, "self-comprising" should be -- self-crimping --.

Column 1, line 19, "yarn, the" should be -- yarn, and --.

Column 2, line 9, after "and" insert -- a --; line 22, "configurations" should be -- configuration --; line 26, "type" should be -- types --.

Column 3, line 58, following "occur" insert -- during --.

Column 4, line 37, "the" should be -- then --.

Column 5, line 29, following "crimped" insert -- composite --; line 44, "panel" should be -- patch --.

Column 6, line 27, "up" should be -- by --.

UNITED STATES PATENT AND TRADEMARK OFFICE

CERTIFICATE OF CORRECTION

PATENT NO. : 4,057,880

DATED : November 15, 1977

INVENTOR(S) : Robert M. Matthews and William J. Lawson

It is certified that error appears in the above-identified patent and that said Letters Patent are hereby corrected as shown below:

Column 7, line 36, "by" should be -- but --; line 40, following "thirty-five" insert -- times --;

Column 8, under "Table III" the headings should read as follows: -- Type of Texture, K.D.K. Raw Nylon, Conventional N-780, K.D.K. N-780 --;

Column 9, line 7, "specifications" should be -- specification --.

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*